US011499262B2

(12) United States Patent
Kwon et al.

(10) Patent No.: US 11,499,262 B2
(45) Date of Patent: Nov. 15, 2022

(54) LAUNDRY TREATING APPARATUS

(71) Applicant: LG ELECTRONICS INC., Seoul (KR)

(72) Inventors: Yongwoo Kwon, Seoul (KR); Gyuri Kim, Seoul (KR); Juhyeong Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 420 days.

(21) Appl. No.: 16/776,780

(22) Filed: Jan. 30, 2020

(65) Prior Publication Data

US 2020/0248395 A1 Aug. 6, 2020

(30) Foreign Application Priority Data

Feb. 1, 2019 (KR) ..... 10-2019-0014065
May 17, 2019 (KR) ..... 10-2019-0058241

(51) Int. Cl.
*D06F 39/14* (2006.01)
*D06F 23/02* (2006.01)

(52) U.S. Cl.
CPC ..... *D06F 39/14* (2013.01); *D06F 23/025* (2013.01)

(58) Field of Classification Search
CPC ..... D06F 21/02; D06F 21/04; D06F 23/02; D06F 23/025; D06F 37/10; D06F 37/18; D06F 37/28; D06F 39/14; D06F 49/003
See application file for complete search history.

(56) References Cited

U.S. PATENT DOCUMENTS

| | | | |
|---|---|---|---|
| 6,256,823 | B1 | 7/2001 | Kronbetter et al. |
| 8,148,633 | B2 | 4/2012 | Hung |
| 8,555,681 | B2 | 10/2013 | Caudevilla De Sola et al. |
| 8,570,737 | B2 | 10/2013 | Rayner |
| 2004/0177656 | A1 | 9/2004 | Kwon |
| 2005/0034486 | A1 | 2/2005 | Bienick et al. |

(Continued)

FOREIGN PATENT DOCUMENTS

| | | |
|---|---|---|
| CN | 1475621 | 2/2004 |
| CN | 1607290 | 4/2005 |

(Continued)

OTHER PUBLICATIONS

European Search Report dated Jun. 24, 2020 issued in EP Application No. 20152188.7.

(Continued)

*Primary Examiner* — David G Cormier
(74) *Attorney, Agent, or Firm* — KED & Associates

(57) ABSTRACT

A laundry treating apparatus may include a main body having a laundry input port at a front surface thereof; a laundry accommodating portion provided inside of the main body to accommodate laundry; and a door rotatably coupled to a front surface of the main body to open and close the laundry input port. The door may include an outer frame facing an outside of the main body; an inner frame facing an inside of the main body and coupled to a rear surface of the outer frame; a front glass mounted to the outer frame; and a door window mounted to the inner frame. A plating layer may be provided on an outer surface of the outer frame, thereby enhancing a sense of quality of the laundry treating apparatus and visibility of the door.

16 Claims, 9 Drawing Sheets

(56) References Cited

U.S. PATENT DOCUMENTS

| | | | | |
|---|---|---|---|---|
| 2005/0138974 | A1 | 6/2005 | Ha et al. | |
| 2005/0262681 | A1* | 12/2005 | Yoon | D06F 39/14 68/3 R |
| 2006/0117813 | A1 | 6/2006 | Ha et al. | |
| 2006/0218975 | A1 | 10/2006 | Graute et al. | |
| 2007/0051012 | A1* | 3/2007 | Schoene | D06F 37/28 68/196 |
| 2007/0125132 | A1 | 6/2007 | Hwang | |
| 2007/0137261 | A1 | 6/2007 | Kwon | |
| 2007/0240456 | A1 | 10/2007 | Byun et al. | |
| 2008/0223085 | A1 | 9/2008 | Park | |
| 2008/0302141 | A1 | 12/2008 | Chung | |
| 2009/0165391 | A1 | 7/2009 | Kocak et al. | |
| 2011/0025178 | A1 | 2/2011 | Schöne | |
| 2011/0050059 | A1 | 3/2011 | Kim et al. | |
| 2015/0000200 | A1 | 1/2015 | Kim et al. | |
| 2015/0003027 | A1 | 1/2015 | Han et al. | |
| 2016/0369445 | A1 | 12/2016 | Kim et al. | |
| 2017/0121884 | A1 | 5/2017 | Kwon et al. | |
| 2017/0121889 | A1 | 5/2017 | Kwon et al. | |
| 2017/0121890 | A1 | 5/2017 | Kwon et al. | |
| 2017/0167070 | A1 | 6/2017 | Khamprachom et al. | |
| 2017/0183803 | A1 | 6/2017 | Kim et al. | |
| 2017/0260678 | A1 | 9/2017 | Wee et al. | |
| 2018/0002853 | A1 | 1/2018 | Anand et al. | |
| 2018/0163333 | A1 | 6/2018 | Zhang et al. | |
| 2018/0195226 | A1 | 7/2018 | Kwon et al. | |
| 2018/0216282 | A1 | 8/2018 | Lee et al. | |
| 2018/0274155 | A1 | 9/2018 | Anand et al. | |
| 2018/0363198 | A1 | 12/2018 | Gim | |
| 2019/0071815 | A1 | 3/2019 | Woodham, Jr. et al. | |

FOREIGN PATENT DOCUMENTS

| | | |
|---|---|---|
| CN | 1880559 | 12/2006 |
| CN | 1940167 | 4/2007 |
| CN | 101074531 | 11/2007 |
| CN | 101671930 | 3/2010 |
| CN | 104372569 | 2/2015 |
| CN | 104420137 | 3/2015 |
| CN | 204311247 | 5/2015 |
| CN | 104975466 | 10/2015 |
| CN | 204780322 | 11/2015 |
| CN | 105937137 | 9/2016 |
| CN | 106012423 | 10/2016 |
| CN | 106032611 | 10/2016 |
| CN | 106133231 | 11/2016 |
| CN | 205907515 | 1/2017 |
| CN | 107287850 | 10/2017 |
| CN | 107541888 | 1/2018 |
| CN | 107641942 | 1/2018 |
| CN | 107974810 | 5/2018 |
| CN | 108796966 | 11/2018 |
| CN | 208293271 | 12/2018 |
| CN | 109112795 | 1/2019 |
| DE | 29721320 | 2/1998 |
| DE | 20 2012 101253 | 4/2013 |
| DE | 20 2014 010 568 | 2/2016 |
| EP | 0 870 861 | 10/1998 |
| EP | 1 262 589 | 12/2002 |
| EP | 1 522 623 | 4/2005 |
| EP | 1 309 749 | 12/2005 |
| EP | 1 860 228 | 11/2007 |
| EP | 2 147 996 | 1/2010 |
| EP | 2 161 364 | 3/2010 |
| EP | 2 677 076 | 12/2013 |
| EP | 3 112 524 | 1/2017 |
| EP | 2 740 833 | 4/2017 |
| EP | 3 162 945 | 5/2017 |
| EP | 3 181 750 | 6/2017 |
| EP | 3 363 945 | 8/2018 |
| EP | 3 875 670 | 9/2021 |
| FR | 2691298 | 11/1993 |
| FR | 2 733 258 | 10/1996 |
| FR | 2756575 | 6/1998 |
| GB | 2118580 | 11/1983 |
| GB | 2320507 | 6/1998 |
| IT | VR20120061 | 9/2017 |
| JP | H06-31766 | 4/1994 |
| JP | H10-24130 | 1/1998 |
| JP | 2000-145022 | 5/2000 |
| JP | 2005-058771 | 3/2005 |
| JP | 2005-160952 | 6/2005 |
| JP | 2008-295957 | 12/2008 |
| JP | 2010-063522 | 3/2010 |
| JP | 2012-075689 | 4/2012 |
| JP | 2012-223344 | 11/2012 |
| JP | 2014-003293 | 1/2014 |
| JP | 2014-151948 | 8/2014 |
| JP | 2016-049112 | 4/2016 |
| JP | 2017-038828 | 2/2017 |
| JP | 2017-099993 | 6/2017 |
| JP | 2018-514346 | 6/2018 |
| JP | 2018-110645 | 7/2018 |
| JP | 2018-531753 | 11/2018 |
| JP | 2018-532545 | 11/2018 |
| JP | 2018-536517 | 12/2018 |
| KR | 10-2004-0011219 | 2/2004 |
| KR | 10-0465148 | 1/2005 |
| KR | 2005-0021057 | 3/2005 |
| KR | 10-0595180 | 6/2006 |
| KR | 10-2007-0002458 | 1/2007 |
| KR | 10-2007-0044599 | 4/2007 |
| KR | 10-2007-0070780 | 7/2007 |
| KR | 10-2010-0019091 | 2/2010 |
| KR | 10-2010-0042984 | 4/2010 |
| KR | 10-2011-0013011 | 2/2011 |
| KR | 10-2011-0028899 | 3/2011 |
| KR | 10-1138697 | 6/2012 |
| KR | 10-1156707 | 6/2012 |
| KR | 10-2014-0006647 | 1/2014 |
| KR | 10-2015-0003592 | 1/2015 |
| KR | 10-2015-0006264 | 1/2015 |
| KR | 10-2016-0041886 | 4/2016 |
| KR | 10-1708350 | 2/2017 |
| KR | 10-1708351 | 2/2017 |
| KR | 10-1708352 | 2/2017 |
| KR | 10-1708355 | 2/2017 |
| KR | 10-2018-0089992 | 8/2018 |
| KR | 10-2018-0136086 | 12/2018 |
| KR | 10-2018-0136094 | 12/2018 |
| KR | 10-2018-0136095 | 12/2018 |
| KR | 10-2018-0136102 | 12/2018 |
| RU | 2355836 | 5/2009 |
| WO | WO 2015/144236 | 10/2015 |
| WO | WO 2017/020959 | 2/2017 |
| WO | WO 2018/001160 | 1/2018 |
| WO | WO 2018/077130 | 5/2018 |
| WO | WO 2018/121942 | 7/2018 |
| WO | WO 2018/138946 | 8/2018 |

OTHER PUBLICATIONS

European Search Report dated Jun. 24, 2020 issued in EP Application No. 20152181.2.

European Search Report dated Jun. 24, 2020 issued in EP Application No. 20152156.4.

European Search Report dated Jul. 1, 2020 issued in EP Application No. 20152169.7.

European Search Report dated Jul. 7, 2020 issued in EP Application No. 20152158.0.

Russian Notice of Allowance dated Aug. 25, 2020 issued in RU Application No. 2020103247.

Australian Office Action dated Sep. 2, 2020 issued in AU Application No. 2020200550.

Chinese Office Action dated Mar. 3, 2022 issued in CN Application No. 201911291955.6.

Chinese Office Action dated Mar. 4, 2022 issued in CN Application No. 201911338352.7.

Chinese Office Action dated Mar. 8, 2022 issued in CN Application No. 201911356949.4.

(56) References Cited

OTHER PUBLICATIONS

Chinese Office Action dated Mar. 17, 2022 issued in CN Application No. 201911338904.4.
Chinese Office Action dated Mar. 21, 2022 issued in CN Application No. 201911265766.1.
Chinese Office Action dated Apr. 2, 2022 issued in CN Application No. 201911356952.6.
Australian Examination Report dated Aug. 17, 2020 issued in Application No. 2020200534.
United States Office Action dated Jan. 14, 2022 issued in co-pending related U.S. Appl. No. 16/776,695.
United States Office Action dated Jan. 24, 2022 issued in co-pending related U.S. Appl. No. 16/776,739.
Australian Office Action dated Apr. 1, 2021 issued in AU Application No. 2020200550.
U.S. Office Action dated Dec. 15, 2021 issued in U.S. Appl. No. 16/776,820.
Russian Notice of Allowance dated Apr. 21, 2020 issued in RU Application No. 2020103239.
Russian Notice of Allowance dated May 15, 2020 issued in RU Application No. 2020103240.
Russian Office Action dated Jun. 18, 2020 issued in RU Application No. 2020103247.
International Search Report dated May 18, 2020 issued in PCT Application No. PCT/KR2020/001531.
Australian Office Action dated Sep. 17, 2020 issued in AU Application No. 2020200522.
United States Office Action dated Mar. 2, 2022 issued in co-pending related U.S. Appl. No. 16/776,779.
European Search Report dated Jun. 29, 2020 issued in Application No. 20152175.4.
Russian Notice of Allowance dated May 25, 2020 issued in RU Application No. 2020102678.
European Search Report dated Jul. 1, 2020 issued in EP Application No. 20152172.1.
Russian Office Action issued in Application No. 2020200539 dated Jun. 11, 2020.
European Search Report issued in Application No. 20152173.9 dated Jul. 1, 2020.
Australian Office Action issued in Application No. 2020102680/03 dated Aug. 17, 2020.
Chinese Office Action issued in Application No. 201911356954.5 dated May 7, 2022.
U.S. Appl. No. 16/776,624, filed Jan. 30, 2020.
U.S. Appl. No. 16/776,639, filed Jan. 30, 2020.
U.S. Appl. No. 16/776,683, filed Jan. 30, 2020.
U.S. Appl. No. 16/776,695, filed Jan. 30, 2020.
U.S. Appl. No. 16/776,739, filed Jan. 30, 2020.
U.S. Appl. No. 16/776,780, filed Jan. 30, 2020.
U.S. Appl. No. 16/776,779, filed Jan. 30, 2020.
U.S. Appl. No. 16/776,820, filed Jan. 30, 2020.

* cited by examiner

LAUNDRY TREATING APPARATUS

CROSS-REFERENCE TO RELATED APPLICATION(S)

Pursuant to 35 U.S.C. § 119(a), this application claims the benefit of an earlier filing date of and the right of priority to Korean Patent Applications No. 10-2019-0014065, filed in Korea on Feb. 1, 2019, No. 10-2019-0058241, filed in Korea on May 17, 2019, the contents of which are incorporated by reference herein in its entirety.

BACKGROUND

1. Field

A laundry treating apparatus capable of improving visibility of a door is disclosed herein.

2. Background

In general, a laundry treating apparatus may include an apparatus having a function of washing or drying laundry or other items (hereinafter, collectively "laundry"). In addition, the laundry treating apparatus may be configured to have both a washing function and a drying function of the laundry.

The laundry treating apparatus may include a main body having a laundry inlet port, a door configured to open and close the laundry inlet port, and a laundry accommodating portion provided in the body. The door may include a door frame, a front glass attached to a front surface of the door frame, and a door window mounted on the door frame to protrude through the laundry input port. A circular opening having a predetermined radius may be disposed at a center of the door frame.

Each of the front glass and the door window may be made of a transparent material, and mounted on front and rear surfaces of the door frame to cover the opening, thereby having an advantage of allowing a user to look into the laundry accommodating portion through the front glass and the door window. However, according to a laundry treating apparatus in the related art, as a shape and structure of the door frame is visible to the naked eye through the front glass, an appearance of the door frame may greatly affect an overall design of the laundry treating apparatus, and play an important role in determining a quality grade of the laundry treating apparatus. In addition, as the front glass and the door window are made of a transparent material, it has a problem of blurring a boundary between the door frame and its surroundings.

BRIEF DESCRIPTION OF THE DRAWINGS

Embodiments will be described in detail with reference to the following drawings in which like reference numerals refer to like elements, and wherein.

DETAILED DESCRIPTION

Figure 1:
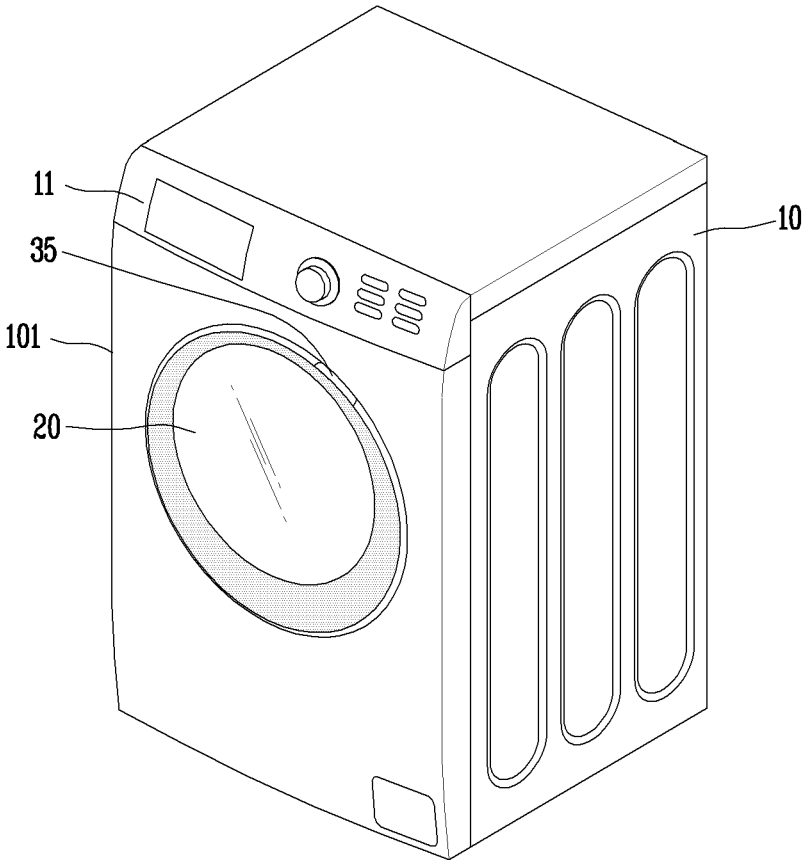
FIG. 1 is a perspective view of a laundry treating apparatus according to an embodiment.

Hereinafter, embodiments will be described with reference to the accompanying drawings. In the drawings, the same or similar elements are designated with the same or similar reference numerals, and redundant description has been omitted. The suffixes "module" and "unit" for components or elements used in the following description are given or mixed in consideration of ease in creating specification, and do not have distinct meanings or roles. In describing embodiments, if a detailed explanation for a related known technology or construction is considered to unnecessarily divert the gist, such explanation has been omitted but would be understood by those skilled in the art. Also, it should be understood that the accompanying drawings are merely illustrated to easily explain the concept, and therefore, they should not be construed to limit the technological concept disclosed herein by the accompanying drawings, and the concept should be construed as being extended to all modifications, equivalents, and substitutes included in the concept and technological scope.

Terms including ordinal numbers such as first and second may be used to describe various elements, but the elements are not limited by the terms. The terms are used merely for the purpose to distinguish an element from another element.

It will be understood that when an element is referred to as being "connected with" another element, the element can be directly connected with the other element or intervening elements may also be present. On the contrary, in case where an element is "directly connected" or "directly linked" to another element, it should be understood that any other element is not existed therebetween.

Singular expressions include plural expressions unless the context clearly indicates otherwise.

Terms "include" or "has" used herein should be understood that they are intended to indicate the existence of a feature, a number, a step, a constituent element, a component or a combination thereof disclosed in the specification, and it may also be understood that the existence or additional possibility of one or more other features, numbers, steps, elements, components or combinations thereof are not excluded in advance.

FIG. 1 is a perspective view of a laundry treating apparatus according to an embodiment. The laundry treating apparatus may include a main body 10, a tub, a drum, and a door 12.

The main body 10 may define an outer shape or appearance of the laundry treating apparatus. The main body 10 may have a rectangular parallelepiped shape.

The main body 10 may include a front panel 101 disposed with a laundry inlet port 102, a rear panel, side panels and an upper panel, and a lower panel. The rear panel and the side panels may be defined by bending one plate in a "t" shape.

The laundry inlet port 102 may be defined in a circular shape on the front panel 101. The laundry inlet port 102 may pass through the front panel 101. A recess 103 may be disposed on the front panel 101 to be recessed toward an inside of the main body 10 to surround the laundry inlet port 102. The laundry inlet port 102 may protrude rearward from the front panel 101 toward an inner space of the main body 10. A portion of the door 12 may be accommodated in the recess 103.

The door 12 may be rotatably coupled to the front panel 101 by a hinge unit 24 to open and close the laundry input port 102. The laundry accommodating portion may be provided inside of the main body 10. The laundry accommodating portion may include a drum to perform a drying function, or a tub and a drum to perform washing and drying functions together.

In one embodiment, in order to perform a drying function along with a washing function, a tub and a drum may be provided inside of the main body 10. The tub may be defined in a cylindrical shape. A central shaft of the tub in a lengthwise direction may be disposed horizontally or in an inclined manner at a predetermined angle. Wash water may be stored inside of the tub. The drum may be rotatably provided inside of the tub.

A gasket may be provided at a front end portion of the tub to communicate with the laundry inlet port 102 so as to prevent the wash water stored inside of the tub from leaking into an accommodation space of the main body 10. The drum may be provided to be rotatable with respect to the tub inside of the tub.

An opening may be disposed at a front side of the drum, and in communication with the laundry input port 102. Laundry may be accommodated inside of the drum through the laundry input port 102.

A drive motor may be provided on a rear surface of the tub, and the drive motor may be connected to a rotational shaft on a rear surface of the drum to rotate the drum by transmitting power of the drive motor to the drum through the rotational shaft as the drive motor is driven. A plurality of through holes may be arranged on a circumferential surface of the drum to allow a fluid, such as wash water, to enter and exit the drum through the plurality of through holes. The drum may have a plurality of lifters therein to rotate laundry accommodated inside of the drum, thereby performing washing and drying functions.

A controller 11 may be provided in or on the main body 10 or provided in or on the door 12. In this embodiment, controller 11 is located above the front panel 101 of the main body 10.

The controller 11 may be configured to display information related to operations of the laundry treating apparatus to a user and to receive a user's input. The controller 11 may include a circular knob and a plurality of buttons for receiving the user's input, for example. In addition, the controller 11 may include a display that displays visual information.

The controller 11 may be provided in the main body 10 or provided in the door 12. In this embodiment, the controller 11 is located above the front panel 101 of the main body 10.

Figure 2:
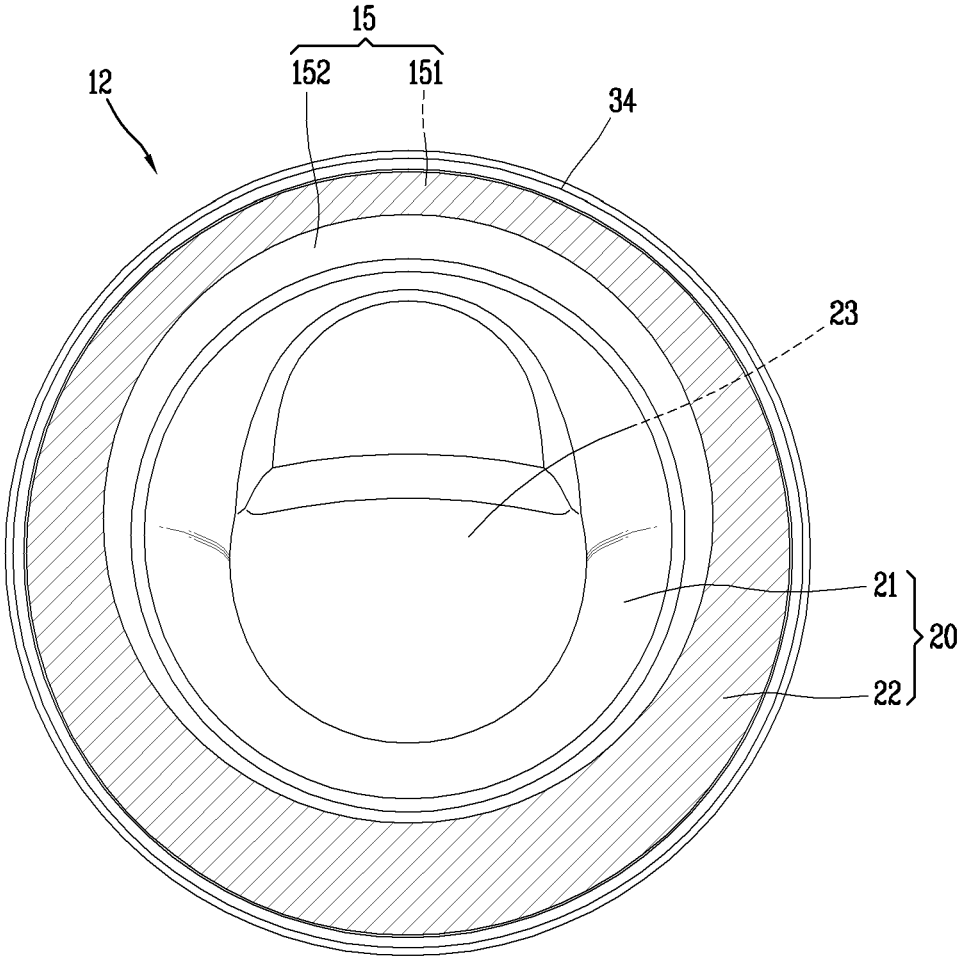
FIG. 2 is a front view of a door in FIG. 1.
Figure 3:
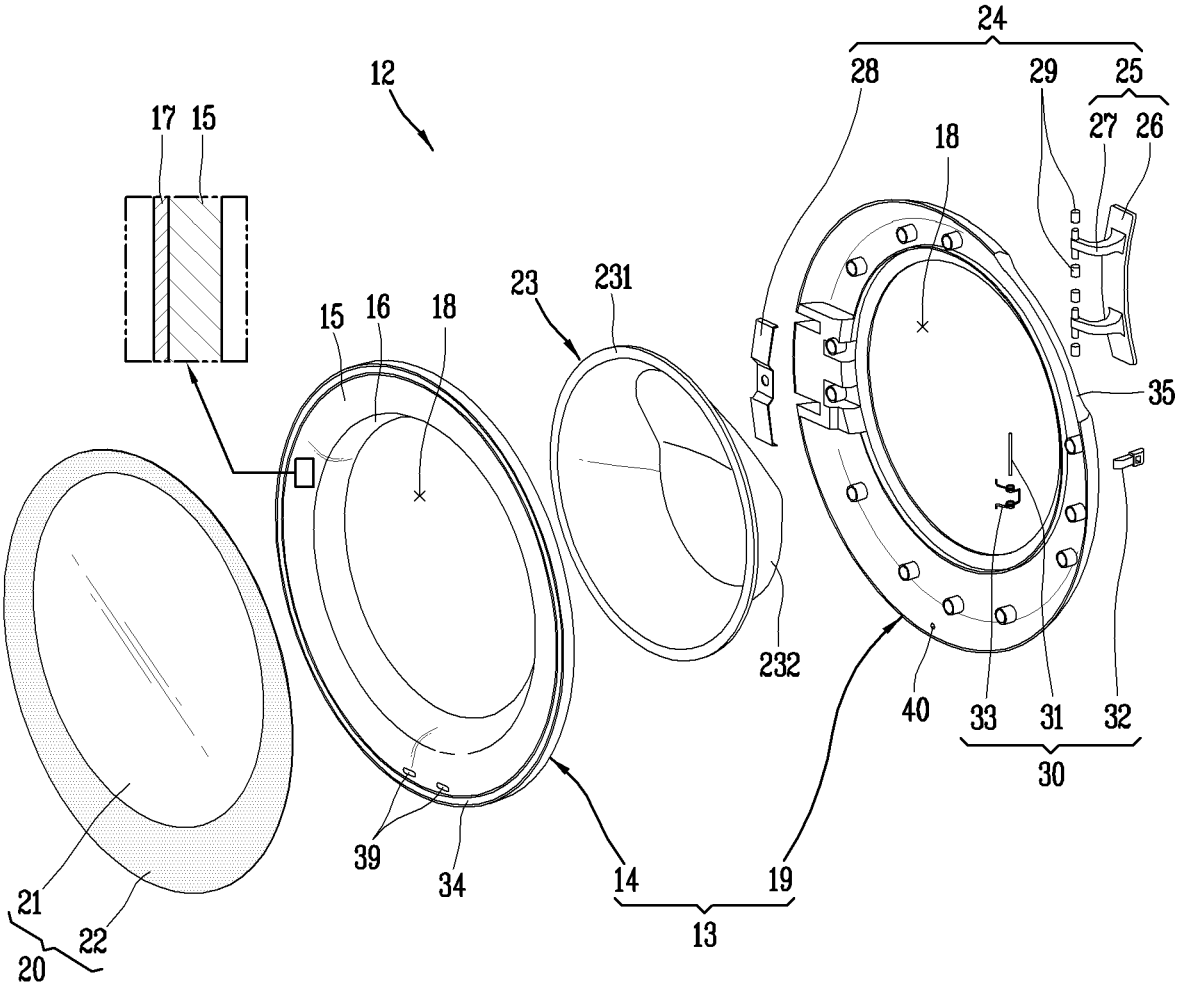
FIG. 3 is an exploded view of the door in FIG. 2.
Figure 4:
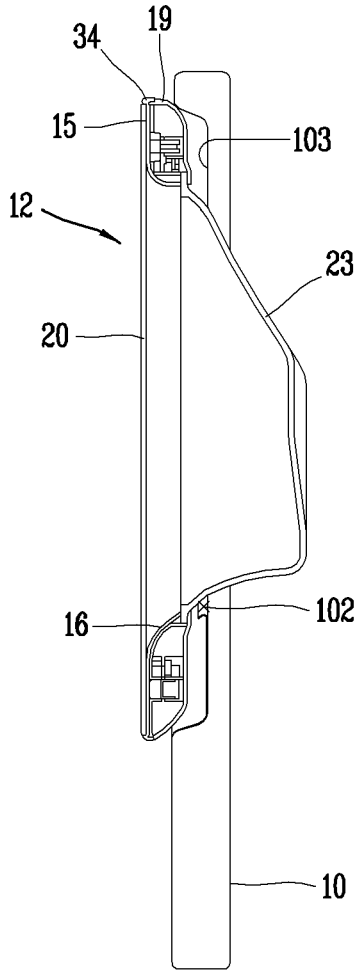
FIG. 4 is a cross-sectional view showing a state in which a door is mounted on a front panel of a main body to close a laundry input port.
Figure 5:
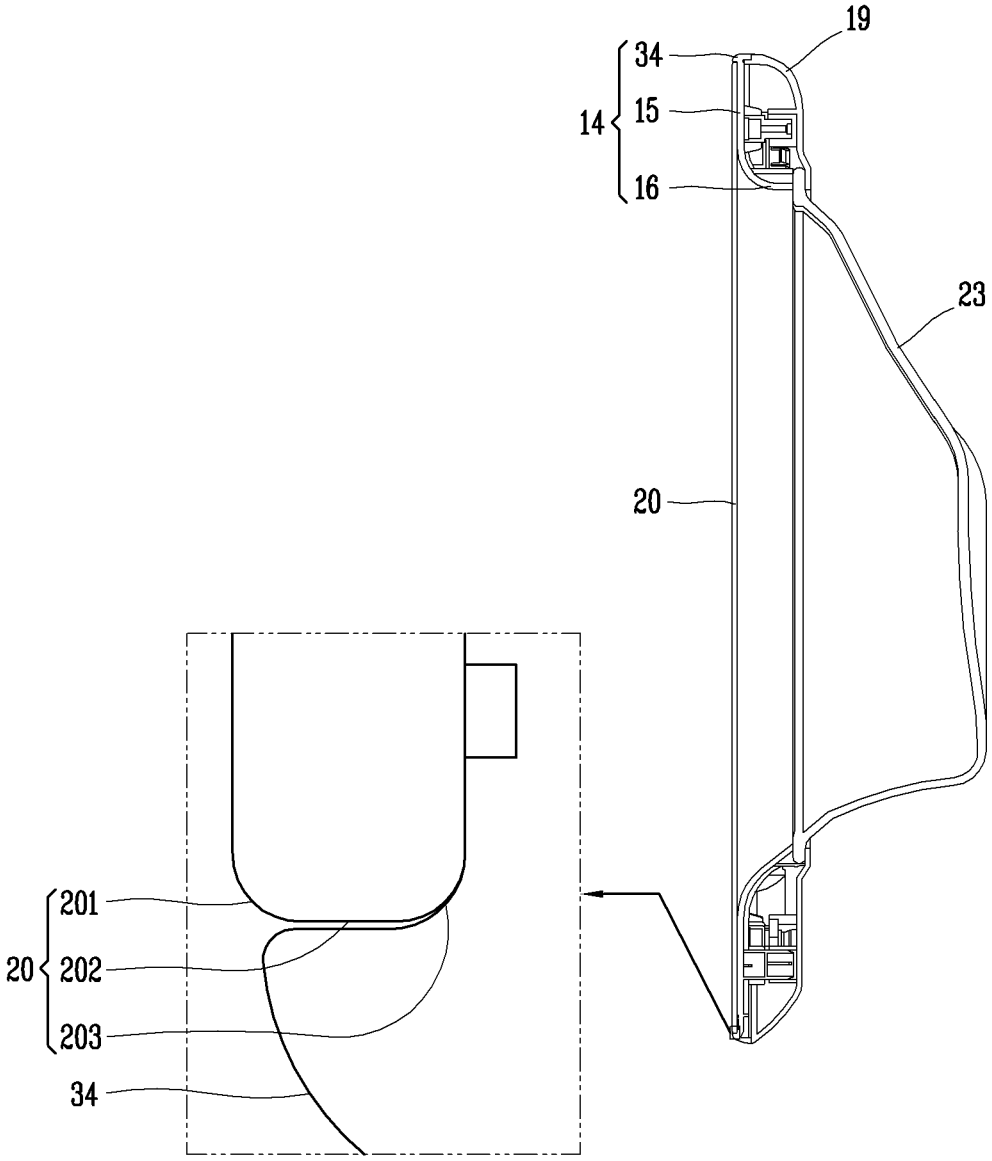
FIG. 5 is a schematic view showing only the door in FIG. 4.

FIG. 2 is a front view of the door 12 in FIG. 1. FIG. 3 is an exploded view of the door 12 in FIG. 2. FIG. 4 is a cross-sectional view showing a state in which the door 12 is mounted on a front panel of the main body to close the laundry input port 102. FIG. 5 is a schematic view showing only the door 12 in FIG. 4.

The door 12 may include a door frame 13, a door window 23, a front glass 20, a hinge unit 24, and a locking unit 30. The door frame 13 may have a ring shape.

The door frame 13 may include an outer frame 14 and an inner frame 19. The outer frame 14 and the inner frame 19 may be made of a synthetic resin material, such as a ABS material, or a PC material, for example. Each of the outer frame 14 and the inner frame 19 may be manufactured by injection molding, for example, when made of a synthetic resin material.

The outer frame 14 and the inner frame 19 each may have, respectively, a ring shape, and may be overlapped and fastened to each other in a frontward-rearward direction. Each of the outer frame 14 and the inner frame 19 may be provided with a hook 36 on an outer circumference thereof to engage with each other by, for example, an interference or snap fit.

The outer frame 14 and the inner frame 13 are named as such as the outer frame 14 is disposed toward or facing an outside of the main body 10 and the inner frame 19 is disposed toward or facing an inside of the main body 10 based on a state in which the door 12 is closed. The outer frame 14 may be referred to as a "first frame", and the inner frame 19 may be referred to as a "second frame".

Circular openings 18 may be disposed at inner sides of the outer frame 14 and the inner frame 19, respectively, to correspond to each other, and the opening 18 may be positioned eccentrically from a center (C2) of each of the outer frame 14 and the inner frame 19. For example, a center (C1) of the opening 18 may be positioned above the center (C2) of each of the outer frame 14 and the inner frame 19.

According to this embodiment, each of the outer frame 14 and the inner frame 19 may vary in width along a circumferential direction. In other words, a distance (width) between an outer diameter and an inner diameter (the opening 18 diameter) of each of the outer frame 14 and the inner frame 19 may increase (widen) from a top end to a bottom end.

A center of the drum may be disposed higher than a center of a height (½) of the main body 10. The drum may be fixed in a heightwise direction of the main body 10 aside from minute vibration due to rotation.

Consumers tend to prefer a larger size of the door 12 to a same capacity and size of the washing machine when looking at the body 10 from the front. In addition, consumers are able to look into the drum through the door 12, and if possible, prefer to have a wide field of view with regard to an inner space of the drum.

In order to satisfy the needs of the above-mentioned consumers, the door 12 must be enlarged downward to increase the size of the door 12 while a position of the drum is fixed. A center of the door frame 13 must move below a center of the laundry inlet port 102 or the opening 18. Similarly, the center of the door frame 13 may move downward with respect to the door window 23 positioned to correspond to the opening 18.

In addition, in order to enlarge the size of the door 12, a portion of the door 12 may protrude outward from the recess 103, and a diameter of the door 12 may be large.

The front glass 20 may be defined in a complete circular shape having a predetermined radius. The front glass 20 may be made of a glass material. Further, the front glass 20 may have flat front and rear surfaces. The front glass 20 may have a disc shape having a predetermined thickness, without bending, when viewed from any direction, up, down, left, or right.

As described above, the front and rear surfaces of the front glass 20 made of a glass material may have a flat complete circular shape, thereby enhancing a quality grade of the door 12, compared to a door cover in the related art made of a synthetic resin material and having a convex front surface in an incomplete circular shape.

The front glass 20 may cover the opening 18 of the door frame 13. The front glass 20 may be bonded to a front surface of the outer frame 14 by a sealant or an adhesive, for example.

Due to a nature of the glass material, it is easy to break when a fastening hole is drilled in the front glass 20, and thus, the front glass 20 may be attached to the outer frame 14 using an adhesive, for example, to prevent the glass from being broken. On the other hand, the front glass 20 made of a glass material occupies a relatively large load compared to a total load of the door 12. In order to support the load of the front glass 20, a mounting guide 34 to mount the front glass 20 may be provided on a front surface of the outer frame 14.

In particular, the front glass 20 may be made of tempered glass. Due to a nature of tempered glass, front and rear surfaces of the front glass 20 have a high strength, but a circular outer circumferential surface, which is a side surface of the front glass 20, has a low strength. To compensate for this, the mounting guide 34 may be disposed to protrude forward from a front outer circumferential end of the outer frame 14 to surround an outer circumferential surface of the front glass 20, to support the load of the front glass 20 as well as to protect a side or outer circumferential surface of the front glass 20 from an external shock.

A protruding length of the mounting guide 34 may be defined to cover at least ⅔ of the thickness of the front glass 20.

For example, a straight portion 202 and a plurality of curved portions 201, 203 may be defined on a thickness surface cut in a diameter direction from an outer circumferential surface of the front glass 20. The plurality of curved portions 201, 203 may include first curved portion 201 connected to a front surface of the front glass 20 and second curved portion 203 connected to a rear surface of the front glass 20. The straight portion 202 may extend between the first and second curved portions 201, 203 and be connected to the plurality of curved portions 201, 203, respectively. Each of the first curved portion 201, the straight portion 202, and the second curved portion 203 may be ⅓ of the thickness of the front glass 20.

The mounting guide 34 may cover the second curved portion 203 and the straight portion 202 of the front glass 20. The mounting guide 34 may protrude from a front edge portion or edge of the outer frame 14. The mounting guide 34 may extend in a ring shape to define a space in which the front glass 20 may be accommodated.

The mounting guide 34 may surround an outer circumferential surface of the front glass 20. The mounting guide 34 may have a predetermined inner diameter and be completely circular. An inner diameter of the mounting guide 34 may correspond to an outer diameter of the front glass 20.

The transparent region 21 and the non-transparent region 22 may be disposed at inner and outer sides of the front glass 20, respectively. The transparent region 21 denotes a region configured to transmit at least a portion of light so that an inside of the laundry accommodating portion may be viewed by the user. Therefore, the transparent region 21 may include a translucent region.

The transparent region 21 may be disposed to correspond to the opening 18 of the outer frame 14, the opening 18 of the inner frame 19, and the door window 23. While the door 12 is closed, the user may look into the laundry accommodating portion through the transparent region 21.

A center of the transparent region 21 may be located at a position corresponding to a center of the opening 18 of each of the outer frame 14 and the inner frame 19. The corresponding position may include not only perfect alignment with the center, but also, alignment in an eccentric direction of the center. In other words, the center of the transparent region 21 and the center of the opening 18 may coincide, and the eccentric direction of the transparent region 21 may be the same as the eccentric direction of the opening 18.

In this embodiment, the center of the opening 18 is eccentrically located from the center of the door frame 13 to an upper side (12 o'clock direction), and correspondingly, the center of the transparent region 21 is also located from the center of the front glass 20 to the upper side (12 o'clock direction). The center of the transparent region 21 and the center of the opening 18 may coincide.

The non-transparent region 22 may surround the transparent region 21. The non-transparent region 22 does not transmit light therethrough, and thus, the glass itself may appear black in the non-transparent region 22. The non-transparent region 22 may cover a remaining portion of the door frame 13 except for the opening 18 and a portion of the door frame 13.

A boundary line between the transparent region 21 and the non-transparent region 22 surrounding the transparent region 21 may be clearly distinguished by the non-transparent region 22. Alternatively, the boundary between the transparent region 21 and the non-transparent region 22 may be blurred through a halftone technique, thereby providing a visual transition from the transparent region 21 to the non-transparent region 22. The non-transparent region 22 may include a plurality of shielding dots arranged around the transparent region 21, and the plurality of shielding dots may be arranged to have a lower density toward the transparent region 21.

The outer frame 14 may include a flat portion 15 and a curved portion 16. The flat portion 15 may be in contact with a rear surface of the front glass 20, and a portion of the flat portion 15 may overlap with the non-transparent region 22. An adhesive may be applied to the flat portion 15 so that the front glass 20 may be adhered to the flat portion 15.

The curved portion 16 may be curved in an arc shape having a predetermined curvature from an inner end of the flat portion 15 toward a rear side thereof. An inner portion of the flat portion 15 and the curved portion 16 may overlap with an outer edge portion or edge of the transparent region 21. The opening 18 may be disposed at an inner side of the curved portion 16 in a radial direction.

The mounting guide 34 may protrude from the flat portion 15 along the circumferential direction at an outermost portion of the flat portion 15. The mounting guide 34 of the outer frame 14 may surround the outer circumferential surface of the front glass 20, thereby preventing the outer circumferential surface of the front glass 20 from being released radially outward from the flat portion 15 of the outer frame 14.

A plating layer 17 may be disposed on front and outer circumferential surfaces of the outer frame 14 by chromium plating, for example. The outer frame 14 may be completely immersed in a chromium plating solution, and thus, the plating layer 17 may be disposed on an entire surface of the outer frame 14 by chromium plating.

The inner frame 19 may be completely immersed in a chromium plating solution, and thus, the plating layer 17 may be disposed on an entire surface of the inner frame 19 by chromium plating.

The plating layer 17 may coat the outer frame 14 with a silver polished metal color. Accordingly, the plating layer 17 may obtain an effect which looks like bright silver circular droplets. In addition, the plating layer 17 may cause a sense of high quality when viewed with the naked eye.

The door window 23 may be disposed to correspond to the laundry input port 102 when the door 12 is closed. The door window 23 may be mounted to the door frame 13 to correspond to the opening 18 of the inner frame 19.

The door window 23 may be made of a transparent material, for example, a synthetic resin material having a light transmitting property, so that an inner space of the laundry accommodating portion, such as a drum, may be viewed through the door window 23. The door window 23 may not be necessarily limited to a synthetic material, but may also be made of a glass material.

An outer edge portion or edge of the door window 23 may be inserted and coupled between the outer frame 14 and the inner frame 19. The outer edge portion of the door window 23 may have a flat shape, and may be fixed between a rear end of the curved portion 16 of the outer frame 14 and an inner end of the inner frame 19.

A first portion of the door frame 13 may protrude forward from the recess 103 in a closed state of the door 12, and a second portion of door frame 13 may be accommodated in the recess 103. More specifically, the flat portion 15 of the outer frame 14 may protrude forward from the recess 103, and a rear end portion or end of the curved portion 16 of the outer frame 14 may be accommodated inside of the recess 103.

A front portion of an outer circumference of the inner frame 19 may protrude outward from the recess 103, and a rear portion of the outer circumference portion of the inner frame 19 may be accommodated in the recess 103. The front glass 20 may be spaced apart in an outward-forward direction from the recess 103, and disposed vertically.

The door 12 may be rotatably provided in the frontward-rearward direction with respect to the main body 10 by the hinge unit 24. The hinge unit 24 may include a hinge 25, a hinge holder 28, and a bush 29.

The hinge 25 may be fixed to the main body 10, and rotatably coupled to the door frame 13. The hinge 25 may include a plate-shaped base 26 coupled to the main body 10, and a rotation coupling portion 27 that protrudes from the base 26 and is rotatably coupled to the door frame 13. A plurality of rotation coupling portions 27 may be provided and spaced apart in a vertical direction.

The hinge holder 28 may be coupled to the door frame 13 to support the plurality of rotation coupling portions 27 to prevent the plurality of rotation coupling portions 27 from being released from the door frame 13. The bush 29 may be inserted onto a rotational shaft of the rotary coupling portion 27 to efficiently rotate the rotational shaft.

The hinge unit 24 may be mounted at one or a first side of the door 12, and the locking unit 30 may be provided at the other or a second side of the door 12. The locking unit 30 is configured to lock or unlock the door 12 to the body 10.

The locking unit 30 may include a shaft 31, a door latch 32 (door latch), and a spring 33. The shaft 31 may pass through the door latch 32, and be mounted on the door frame 13. The spring 33 has an elastic force to be retractable during rotation of the door latch 32. According to this embodiment, the door latch 32 may be configured to be rotatable and restorable to the door frame 13 so as to lock or unlock the door 12 to the main body 10.

A handle 35 may be disposed in a recessed manner at a rear upper side of the inner frame 19 for the user to open the door 12 by pulling the handle 35. A rear surface of the inner frame 19 may be convex rearward in a curved shape to form the handle 35.

The handle 35 may be disposed at the rear upper side or side surface of the inner frame 19. While the door 12 is closed, the handle 35 may be located at an upper right side, that is, between 1 o'clock and 3 o'clock when viewed from the front of the main body 10.

The handle 35 may be disposed in a recessed manner forward from a convexly formed rear surface of the inner frame 19. The handle 35 may have an arc shape along a partial section in a circumferential direction on the rear surface of the inner frame 19. The handle 35 may have a thin and flat shape compared to an outer circumference of the inner frame 19 (a portion other than the handle 35).

When the door 12 is closed by the user, the handle 35 is recessed forward compared to a rear outer circumference of the inner frame 19 and defined in a flat shape when viewed from the front of the main body 10, thereby facilitating insertion of the user's hand into the handle 35 as well as facilitating identification of a position of the handle 35 in the closed state of the door 12.

Figure 6:
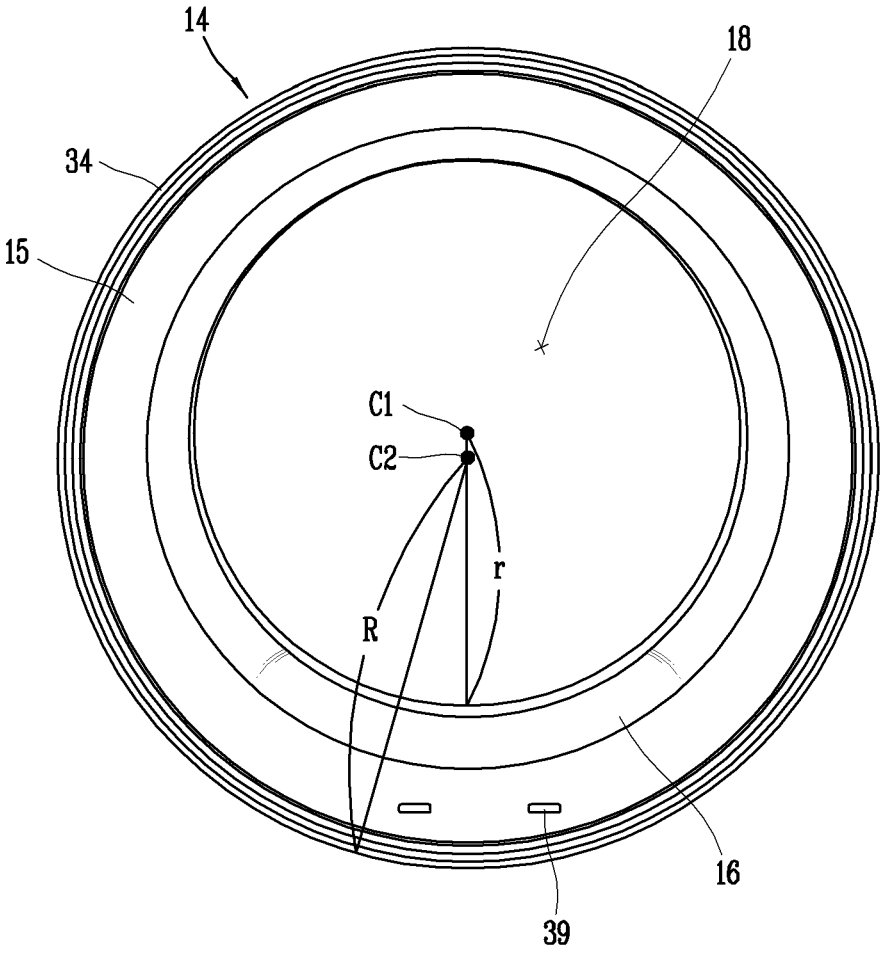
FIG. 6 is a front view of an outer frame after removing a front glass in FIG. 5.
Figure 7:
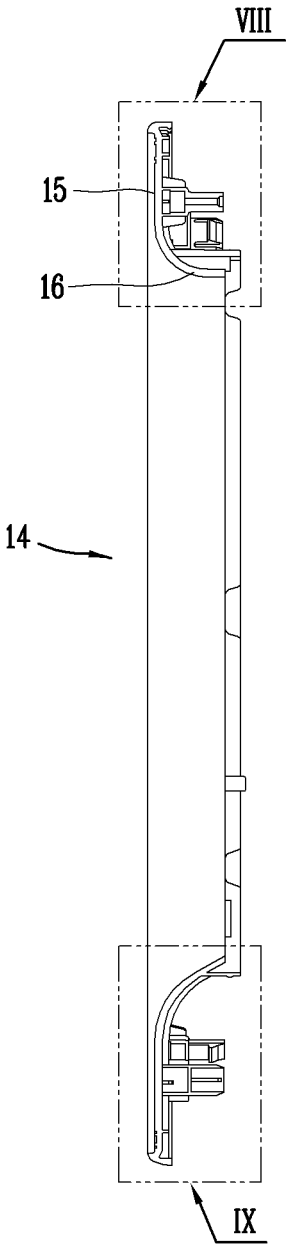
FIG. 7 is a cross-sectional view, taken along line VII-VII in FIG. 6.
Figure 8:
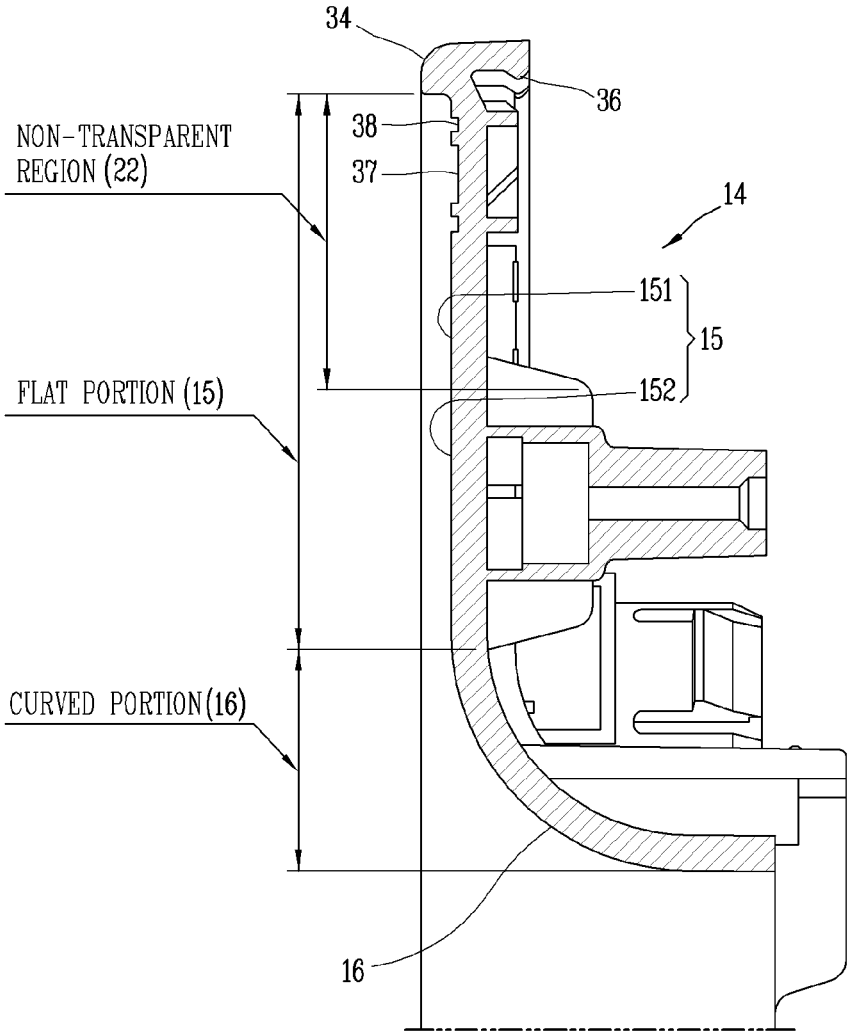
FIG. 8 is a cross-sectional view showing an upper flat portion and an upper curved portion of the outer frame by enlarging a portion "VIII" in FIG. 7.
Figure 9:
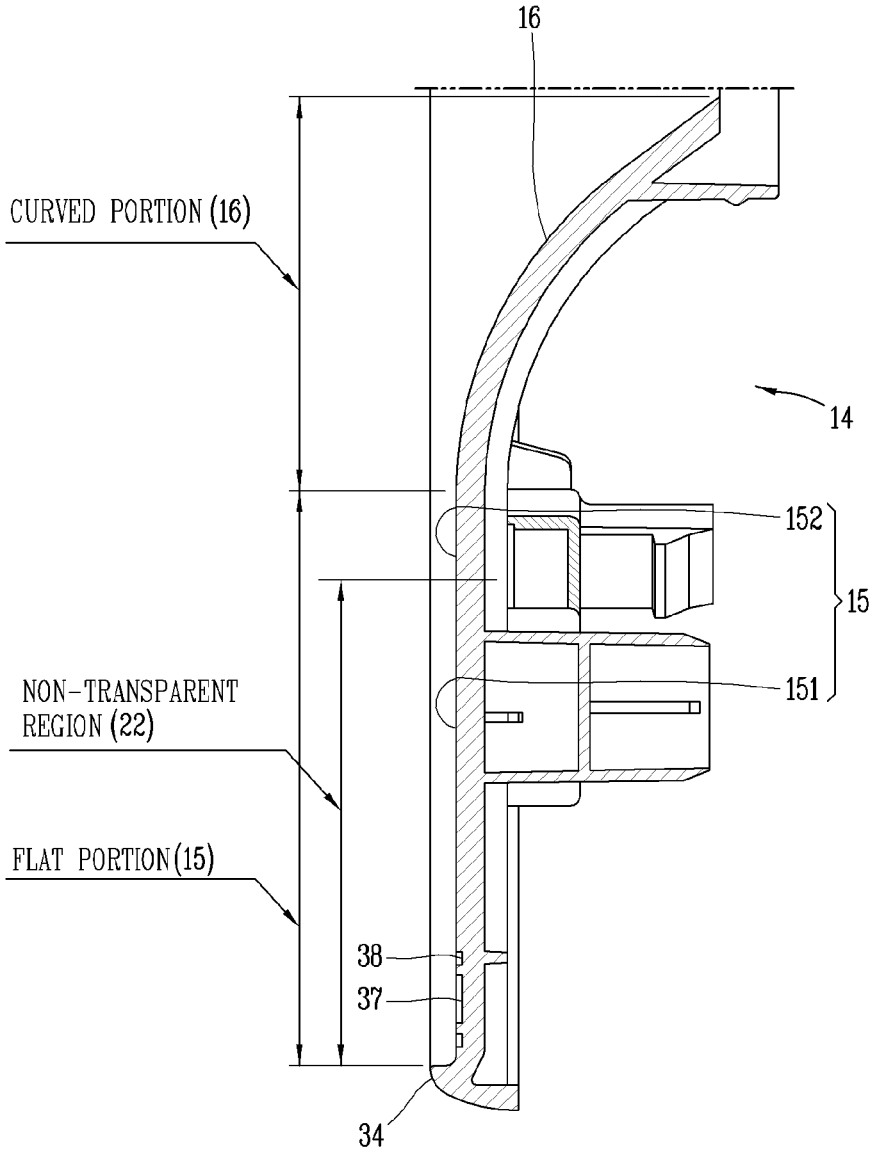
FIG. 9 is a cross-sectional view showing a lower flat portion and a lower curved portion of the outer frame by enlarging a portion "IX" in FIG. 7.

FIG. 6 is a front view of the outer frame 14 after removing the front glass 20 in FIG. 5. FIG. 7 is a cross-sectional view, taken along line VII-VII in FIG. 6. FIG. 8 is a cross-sectional view showing an upper flat portion and an upper curved portion of the outer frame 14 by enlarging a portion "VIII" in FIG. 7. FIG. 9 is a cross-sectional view showing a lower flat portion and a lower curved portion of the outer frame 14 by enlarging a portion "IX" in FIG. 7.

The outer frame 14 may include a flat portion 15 and a curved portion 16. The flat portion 15 may have a flat plate shape disposed perpendicular to an outer side of the outer frame 14. The flat portion 15 may be formed in a ring shape along a circumferential direction of the outer frame 14.

An adhesive groove 37 may be disposed concavely in a ring shape on a front surface of the flat portion 15 facing the front glass 20 to accommodate an adhesive, and a rear surface of the front glass 20 may be bonded to the flat portion 15 by the adhesive. The adhesive may overflow to an outside or an inside of the adhesive groove 37 in a radial direction when the adhesive groove 37 is filled. In order to accommodate the adhesive overflowing from the adhesive groove 37, an adhesive overflow groove 38 may be disposed in a ring shape at the inside and the outside of the adhesive groove 37, respectively.

The adhesive groove 37 and the adhesive overflow groove 38 may be disposed at an outside of the flat portion 15, and the non-transparent region 22 of the front glass 20 may be disposed to cover the adhesive groove 37 and the adhesive overflow groove 38 of the flat portion 15.

A plurality of water drain holes may be arranged in a penetrating manner at a lower side of the flat portion 15 in a thickness direction to discharge water or moisture formed between the rear surface of the front glass 20 and the front surface of the outer frame 14 to the outside through the water drain holes 39.

A water discharge hole 40 may pass through the front panel 101 at a lower end portion or end of the inner frame 19. The water discharge hole 40 may be in communication with a plurality of water drain holes 39 and an outside of the door 12, and water or moisture discharged from the water drain hole 39 may be discharged to the outside of the door 12 through the water discharge hole 40.

The curved portion 16 may be provided at an inner side of the flat portion 15, and may have a predetermined curvature toward the opening 18 of the inner frame 19 from the inner side of the flat portion 15.

The plating layer 17 may be disposed on both front and rear surfaces of the outer frame 14. The plating layer 17 may be disposed on the flat portion 15 and the curved portion 16.

The non-transparent region 22 of the front glass 20 may cover an outer side of the flat portion 15 when viewed from the front of the main body 10. In this embodiment, the flat portion 15 may have a larger radial length than the curved portion 16.

A lower side of the flat portion 15 may have a larger width (radial distance) than an upper side of the flat portion 15. For example, a lower side of the flat portion 15 may be 60 mm (see FIG. 8), and an upper side of the flat portion 15 may be 45 mm (see FIG. 9).

The plurality of water drain hole 39 may be disposed at a lower side of the flat portion 15. The plurality of water drain hole 39 may be located higher than the adhesive groove 37 and the adhesive overflow groove 38. The plurality of water drain holes 39 may be disposed at the inner side of the adhesive groove 37 or the adhesive overflow groove 38.

A lower side of the non-transparent region 22 may have a larger radial width than an upper side of the non-transparent region 22. The non-transparent region 22 may cover the adhesive groove 37 and the adhesive overflow groove 38 disposed at the flat portion 15. The non-transparent region 22 may cover the plurality of water drain holes 39.

The transparent region 21 of the front glass 20 may cover an inner side of the flat portion 15 and the curved portion 16 when viewed from the front of the main body 10. According to this embodiment, the plating layer 17 disposed at an inner side of the flat portion 15 of the outer frame 14 and the curved portion 16 may be viewed through the transparent front glass 20. A user may see light reflected by the plating layer 17, thereby improving a sense of quality of the laundry treating apparatus and improving a visibility of the door.

Referring to FIGS. 8 and 9, the flat portion 15 may be divided into a covered portion 151 which is covered by the non-transparent region 22 and a non-covered portion 152 which is not covered by the non-transparent region 22. The non-covered portion 152 is a portion that is viewable through the transparent region 21.

Each of the covered portion 151 and the non-covered portion 152 may be defined differently along a circumferential direction of the flat portion 15. For example, the covered portion 151 may have a larger width from an upper end of the flat portion 15 to a lower end of the flat portion 15. This is because the plurality of water drain holes 39 is disposed at a lower side of the flat portion 15. An upper side of the covered portion 151 may be 20 mm, and a lower side of the covered portion 151 may be 50 mm. Of course, the dimension of the covered portion 151 may not necessarily limited thereto, and may vary depending on a size of the door 12.

The non-covered portion 152 may have a smaller width from an upper end of the flat portion 15 to a lower end of the flat portion 15. An upper side of the non-covered portion 152 may be 20 mm, and a lower side of the non-covered portion 152 may be 10 mm.

In the case of an adult, as the main body 10 is lower than a height of the user depending on a height and position of the main body 10, when the user looks at the door 12 while standing in front of the main body 10, his or her gaze is obliquely directed downward. As such, in consideration of structural characteristics of the outer frame 14 in which the user's gaze is inclined downward toward the door 12, and the flat portion 15 is vertically disposed, and the curved portion 16 is bent in a curved shape toward a rear horizontal direction from an inner end of the flat portion 15, an area of the flat portion 15 visible to the naked eye through the transparent region 21 is smaller than that of the curved portion 16. In particular, as the user approaches the door 12, an area of the flat portion 15 appears to be extremely smaller than that of the curved portion 16.

Further, when the user looks at the door 12 in a standing state, as an upper side of the curved portion 16 is mostly covered by the flat portion 15, a lower side of the curved portion 16 is larger than an upper side of the curved portion 16 in terms of the area of a portion visible to the naked eye through the transparent region 21. Furthermore, in consideration of the user's gaze, the lower side of the curved portion 16 may be larger than the upper side of the curved portion 16. The lower side of the curved portion 16 may have a smaller (smoother) curvature than the upper side of the curved portion 16.

For example, a width of the upper side of the curved portion 16 may be 25 mm (see FIG. 8), and a width of the lower side of the curved portion 16 may be 40 mm (see FIG. 9). An upper front side (12 o'clock) of the outer frame 14 may be 65 mm as a sum of the radial widths of the flat portions 15 (45 mm) and the curved portions 16 (20 mm), and a front lower side (6 o'clock) of the outer frame 14 may be 100 mm as a sum of widths of the flat portion 15 (60 mm) and the curved portion 16 (40 mm).

A diameter of the non-transparent region 22 of the front glass 20 may correspond to (be the same as or similar to) that of the flat portion 15, but a width of the transparent region 22 may be smaller than that of the flat portion 15. The transparent region 21 of the front glass 20 may have a diameter smaller than that of the flat portion 15 and larger than that of the curved portion 16.

For example, a width of the flat portion 15 corresponding to the non-transparent region 22 of the front glass 20 on the flat portion 15 (45 mm) of the outer frame 14 at an upper front side (12 o'clock) of the outer frame 14 may be 20 mm. A width of the flat portion 15 corresponding to the non-transparent region 22 of the front glass 20 on the flat portion 15 (60 mm) of the outer frame 14 at a lower front side (6 o'clock) of the outer frame 14 may be 20 mm. A region where the plating layer 17 of the flat portion 15 and the curved portion 16 is exposed through the transparent region 21 of the front glass 20 may be 45 mm at an upper front side of the outer frame 14, and 50 mm at a lower front side of the outer frame 14 when the front glass 20 is viewed from the front.

According to this embodiment, when the user looks at an upper portion of the front glass 20 because his or her height is higher than that of the main body on the basis of an adult, the lower side of the outer frame 14 is larger than the upper side of the outer frame 14 in terms of the area of the plating layer 17 visible to the naked eye through the front glass 20. Therefore, according to embodiments, light transmitted through the transparent region 21 may be reflected to the user's eyes by the plating layer 17 disposed on the outer frame 14, and the non-transparent region 22 may define an outer boundary of the transparent region 21 in a circular shape, thereby allowing light reflected from the plating layer 17 through the transparent region 21 to appear to the user as large circular drops.

In addition, the plating layer 17 plated on a surface of the outer frame 14 may not only provide a sense of quality to the user, but also improve visibility of the door 12. A lower front side of the outer frame 14 may be defined to have a larger radial width of the flat portion 15 than that of an upper front side of the outer frame 14, thereby further increasing an area of the plating layer 17 exposed to the user.

Embodiments disclosed herein provide a laundry treating apparatus capable of beautifying an appearance of a door to improve a sense of quality. In addition, embodiments disclosed herein provide a laundry treating apparatus capable of improving visibility to visually clearly distinguish a boundary between the door frame and its surroundings.

Embodiments disclosed herein provide a laundry treating apparatus that may include a main body having a laundry input port disposed at a front surface thereof; a laundry accommodating portion provided inside of the main body to accommodate laundry; and a door rotatably provided on a front surface of the main body to open and close the laundry input port. The door may include an outer frame disposed toward an outer side of the main body; an inner frame disposed toward an inner side of the main body and coupled to a rear surface of the outer frame; a front glass mounted to the outer frame; and a door window mounted to the inner frame. A plating layer may be disposed on an outer surface of the outer frame. The plating layer may be formed by chromium plating.

The outer frame may include a flat portion defined in a ring shape, to which the front glass may be attached, and a curved portion extending in an arc shape from an inner circumference of the flat portion toward an outer circumference of the door window. The front glass may be defined in a disc shape, and may include a transparent region that transmits light and exposes part or a first portion of the flat portion and a plating layer disposed on the curved portion to the outside; and a non-transparent region disposed to surround the transparent region so as to cover another part or a second portion of the flat portion. The flat portion may include a covered portion disposed to be covered by the non-transparent region, and a non-covered portion disposed at an inner side of the covered portion, and exposed through the transparent region.

Each of the outer frame and the inner frame may be provided with an opening portion or opening thereinside and defined in a ring shape. A center of the opening portion may be located above a center of each of the outer frame and the inner frame.

A radial length of the flat portion may be larger than that of the curved portion. A radial length of the flat portion may be larger than that of the non-transparent region.

A lower portion of the covered portion positioned below a horizontal center line passing through a center of the outer frame in a horizontal direction may have a larger radial length than that of an upper portion of the covered portion. An upper portion of the non-covered portion positioned above a horizontal center line passing through the center of the outer frame in a horizontal direction may have a larger radial length than that of a lower portion of the non-covered portion.

A lower portion of the curved portion positioned below a horizontal center line passing through the center of the outer frame in a horizontal direction may have a smaller curvature than that of an upper portion of the curved portion. A lower portion of the curved portion positioned below a horizontal center line passing through the center of the outer frame in a horizontal direction may have a larger plating layer area exposed through the transparent region than that of an upper portion of the curved portion.

An adhesive groove may be disposed on the flat portion. The non-transparent region may be disposed to cover the adhesive groove.

A plurality of water drain holes may be arranged at a lower side of the covered portion positioned above a horizontal center line passing through the center of the outer frame in a horizontal direction.

According to embodiments disclosed herein, light transmitted through a transparent region may be reflected to a user's eyes by a plating layer disposed on an outer frame, and a non-transparent region may define an outer boundary of the transparent region in a circular shape, thereby allowing light reflected from the plating layer through the transparent region to appear to the user as a large circular drop of water. The plating layer plated on a surface of the outer frame may not only give the user a sense of quality, but also the non-transparent region of a front glass may clearly distinguish a boundary between the door frame and its surroundings, thereby improving the visibility of a door. A lower front side of the outer frame may have a larger radial width than that of an upper front side of the outer frame, and a lower side of a curved portion may have a smaller curvature than that of an upper side of the curved portion, thereby further increasing an area of the plating layer exposed to the user.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element (s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments of the disclosure are described herein with reference to cross-section illustrations that are schematic illustrations of idealized embodiments (and intermediate structures) of the disclosure. As such, variations from the shapes of the illustrations as a result, for example, of manufacturing techniques and/or tolerances, are to be expected. Thus, embodiments of the disclosure should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A laundry treating apparatus, comprising:

a main body having a laundry input port at a front surface thereof;

a laundry accommodating portion provided inside of the main body to accommodate laundry; and a door rotatably coupled to a front surface of the main body to open and close the laundry input port, wherein the door comprises:

an outer frame facing an outside of the main body;

an inner frame facing an inside of the main body and coupled to a rear surface of the outer frame;

a front glass mounted to the outer frame; and a door window mounted to the inner frame, wherein a plating layer is provided on an outer surface of the outer frame, wherein the outer frame comprises:

a flat portion having a ring shape, to which the front glass is attached; and a curved portion that extends in an arc shape from an inner circumference of the flat portion toward an outer circumference of the door window, wherein the front glass has a disc shape, and wherein the front glass comprises:

a transparent region that transmits light and exposes a first portion of the flat portion and the plating layer, which is disposed on the curved portion, to the outside; and a non-transparent region that surrounds the transparent region so as to cover a second portion of the flat portion.

2. The laundry treating apparatus of claim 1, wherein the plating layer is formed by chromium plating.

3. The laundry treating apparatus of claim 1, wherein each of the outer frame and the inner frame is ring-shaped and provided with an opening, and wherein a center of each of the openings is located above a center of each of the outer frame and the inner frame.

4. The laundry treating apparatus of claim 1, wherein a radial length of the flat portion is larger than a radial length of the non-transparent region.

5. The laundry treating apparatus of claim 1, wherein the flat portion comprises:

a covered portion covered by the non-transparent region; and a non-covered portion at an inner side of the covered portion, and exposed through the transparent region.

6. The laundry treating apparatus of claim 5, wherein a lower portion of the covered portion positioned below a horizontal center line passing through the center of the outer frame in a horizontal direction has a larger radial length than a radial length of an upper portion of the covered portion.

7. The laundry treating apparatus of claim 5, wherein an upper portion of the non-covered portion positioned above a horizontal center line passing through the center of the outer frame in a horizontal direction has a larger radial length than a radial length of a lower portion of the non-covered portion.

8. The laundry treating apparatus of claim 5, wherein a plurality of water drain holes is arranged at a lower side of the covered portion positioned above a horizontal center line passing through a center of the outer frame in a horizontal direction.

9. The laundry treating apparatus of claim 1, wherein a lower portion of the curved portion positioned below a horizontal center line passing through a center of the outer frame in a horizontal direction has a larger plating layer area exposed through the transparent region than a plating layer area of an upper portion of the curved portion.

10. The laundry treating apparatus of claim 1, wherein an adhesive groove is provided on the flat portion, and wherein the non-transparent region covers the adhesive groove.

11. The laundry treating apparatus of claim 1, wherein a radial length of the flat portion is larger than a radial length of the curved portion.

12. The laundry treating apparatus of claim 1, wherein a lower portion of the curved portion positioned below a horizontal center line passing through the center of the outer frame in a horizontal direction has a smaller curvature than a curvature of an upper portion of the curved portion.

13. A laundry treating apparatus, comprising:

a main body having a laundry input port at a front surface thereof;

a laundry accommodating portion provided inside of the main body to accommodate laundry; and a door rotatably coupled to a front surface of the main body to open and close the laundry input port, wherein the door comprises:

an outer frame facing an outside of the main body;

an inner frame facing an inside of the main body and coupled to a rear surface of the outer frame;

a front glass mounted to the outer frame; and a door window mounted to the inner frame, wherein a plating layer is provided on an outer surface of the outer frame, wherein the front glass comprises a transparent region that transmits light and exposes the plating layer to the outside, wherein the outer frame comprises:

a flat portion having a ring shape, to which the front glass is attached; and a curved portion that extends in an arc shape from an inner circumference of the flat portion toward an outer circumference of the door window, wherein the transparent region exposes a first portion of the flat portion and the plating layer, which is disposed on the curved portion, to the outside, and wherein the front glass further comprises a non-transparent region that surrounds the transparent region so as to cover a second portion of the flat portion.

14. The laundry treating apparatus of claim 13, wherein the plating layer is formed by chromium plating.

15. The laundry treating apparatus of claim 13, wherein each of the outer frame and the inner frame is ring-shaped and provided with an opening, and wherein a center of each of the openings is located above a center of each of the outer frame and the inner frame.

16. The laundry treating apparatus of claim 13, wherein a radial length of the flat portion is larger than a radial length of the curved portion.

* * * * *